US011028991B1

(12) United States Patent
Ueno

(10) Patent No.: US 11,028,991 B1
(45) Date of Patent: Jun. 8, 2021

(54) VEHICLE LIGHTING DEVICE AND VEHICLE LAMP

(71) Applicant: Toshiba Lighting & Technology Corporation, Yokosuka (JP)

(72) Inventor: Misaki Ueno, Ehime-ken (JP)

(73) Assignee: Toshiba Lighting & Technology Corporation, Yokosuka (JP)

( * ) Notice: Subject to any disclaimer, the term of this patent is extended or adjusted under 35 U.S.C. 154(b) by 0 days.

(21) Appl. No.: 17/015,497

(22) Filed: Sep. 9, 2020

(30) Foreign Application Priority Data

Nov. 28, 2019 (JP) ..... JP2019-214993

(51) Int. Cl.

| | |
|---|---|
| ***F21V 23/06*** | (2006.01) |
| ***F21S 41/25*** | (2018.01) |
| ***F21S 41/30*** | (2018.01) |
| ***F21S 41/19*** | (2018.01) |
| ***F21S 41/143*** | (2018.01) |
| *F21S 45/48* | (2018.01) |
| *F21Y 115/10* | (2016.01) |

(52) U.S. Cl.
CPC ..... *F21S 41/25* (2018.01); *F21S 41/143* (2018.01); *F21S 41/19* (2018.01); *F21S 41/30* (2018.01); *F21V 23/06* (2013.01); *F21S 45/48* (2018.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 2013/0105850 | A1* | 5/2013 | Komatsu | F21S 41/143 257/98 |
| 2016/0290587 | A1 | 10/2016 | Nakagawa et al. | |
| 2018/0073714 | A1* | 3/2018 | Ozawa | F21S 43/40 |
| 2019/0267518 | A1* | 8/2019 | Hino | F21S 45/50 |

FOREIGN PATENT DOCUMENTS

JP 2016-195099 A 11/2016

* cited by examiner

*Primary Examiner* — Elmito Breval
(74) *Attorney, Agent, or Firm* — Banner & Witcoff, Ltd.

(57) ABSTRACT

A vehicle lighting device according to an embodiment includes: a socket; a substrate that is provided on one end portion side of the socket; a frame portion that is provided on the substrate; at least one light-emitting element that is provided in a region on an inner side of the frame portion on the substrate; a sealing portion that is provided on an inner side of the frame portion and covers the light-emitting element; and an optical element that is provided on the sealing portion. An arithmetic-average roughness value of a first surface on the sealing portion side in the optical element is greater than an arithmetic-average roughness value of a second surface of the optical element on a side opposite to the first surface.

20 Claims, 6 Drawing Sheets

VEHICLE LIGHTING DEVICE AND VEHICLE LAMP

CROSS-REFERENCE TO RELATED APPLICATIONS

This application is based upon and claims the benefit of priority from Japanese Patent Application No. 2019-214993, filed on Nov. 28, 2019; the entire contents of which are incorporated herein by reference.

FIELD

Exemplary embodiments described herein relate to a vehicle lighting device and a vehicle lamp.

BACKGROUND

From the viewpoints of energy saving and long operational lifetime, a vehicle lighting device provided with a light-emitting diode is widely used instead of a vehicle lighting device provided with a filament.

In addition, in order to downsize the vehicle lighting device, a plurality of chip-shaped light-emitting diodes may be used. The plurality of light-emitting diodes are mounted on a substrate. In addition, a frame portion that surrounds the plurality of light-emitting diodes and a sealing portion that is provided on an inner side of the frame portion to cover the plurality of light-emitting diodes are provided on the substrate.

In addition, in order to improve light extraction efficiency or to easily obtain desired light distribution characteristics, there is suggested a technology of providing a lens on a sealing portion. When providing the lens on the sealing portion, the lens is held by a vacuum chuck or the like and the lens is mounted on the sealing portion.

Here, the lens is formed from a material having a light-transmitting property, but it is preferable that the lens is formed from a light-transmitting resin in consideration of the manufacturing cost. However, the light-transmitting resin may have tackiness (stickiness). When the tackiness of the lens is strong, detachment from the vacuum chuck or the like is hindered, and thus there is a concern that a lens mounting position may be deviated. When the lens mounting position deviates, there is a concern that desired light distribution characteristics and the like may not be obtained. In addition, when integrating or transporting a plurality of lenses, the lenses may adhere to each other, or the lens may adhere to an accommodation member such as a tray.

Here, it is desired to develop a technology capable of suppressing tackiness of optical elements such as a lens.

DETAILED DESCRIPTION

Figure 1:
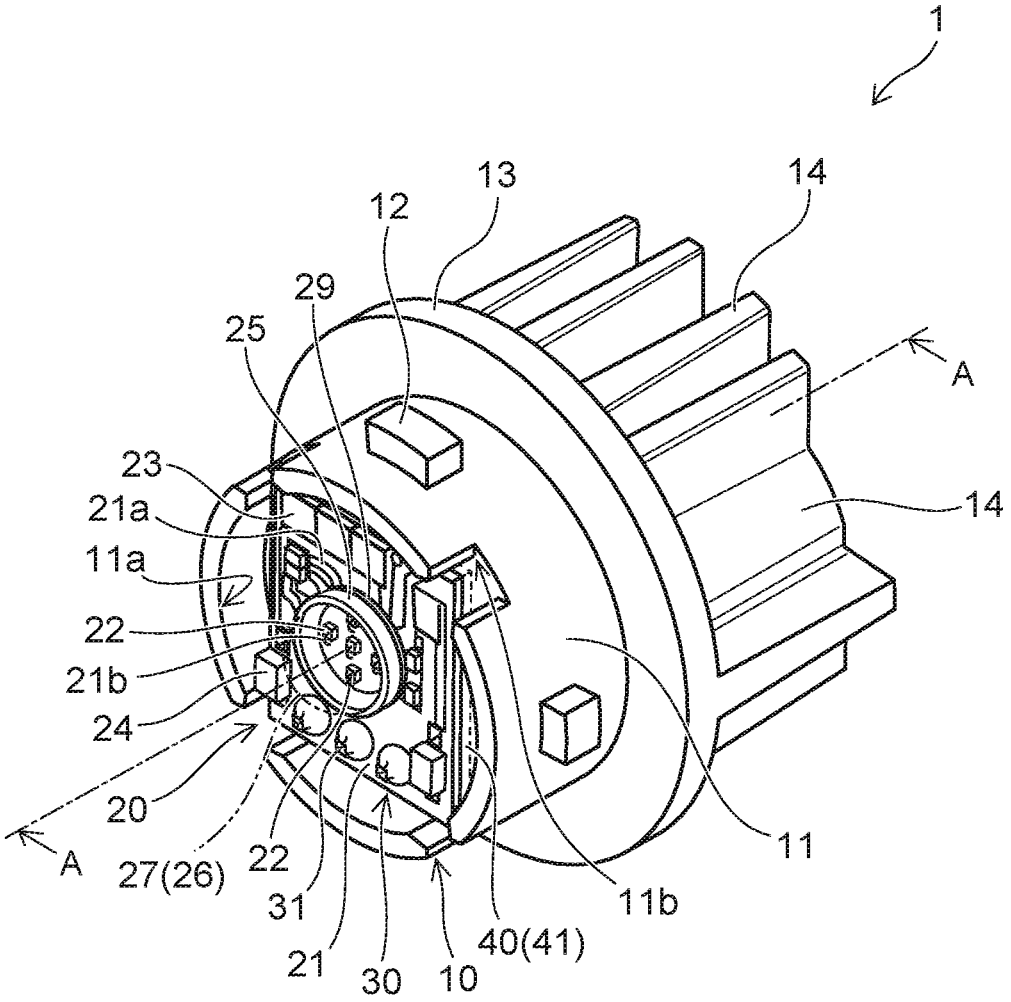
FIG. 1 is a schematic perspective view illustrating a vehicle lighting device according to an embodiment.

A vehicle lighting device according to an embodiment includes a socket, a substrate that is provided on one end portion side of the socket, a frame portion that is provided on the substrate, at least one light-emitting element that is provided in a region on an inner side of the frame portion on the substrate, a sealing portion that is provided on an inner side of the frame portion and covers the light-emitting element, and an optical element that is provided on the sealing portion. An arithmetic-average roughness value of a first surface on the sealing portion side in the optical element is greater than an arithmetic-average roughness value of a second surface on a side opposite to the first surface.

Hereinafter, an embodiment will be described with reference to the accompanying drawings. Note that, in the drawings, the same reference numeral will be given to the same element, and detailed description thereof will be appropriately omitted.

(Vehicle Lighting Device)

A vehicle lighting device 1 according to this embodiment can be provided, for example, in an automobile, a rail way vehicle, or the like. Examples of the vehicle lighting device 1 provided in the automobile include lamps which are used as a front combination light (in which for example, a daytime running lamp (DRL), a position lamp, a turn signal lamp, and the like are appropriately combined), a rear combination light (in which for example, a stop lamp, a tail lamp, a turn signal lamp, a back lamp, a fog lamp, and the like are appropriately combined), and the like. However, applications of the vehicle lighting device 1 are not limited to the lamps.

FIG. 1 is a schematic perspective view illustrating the vehicle lighting device 1 according to the embodiment.

Figure 2:
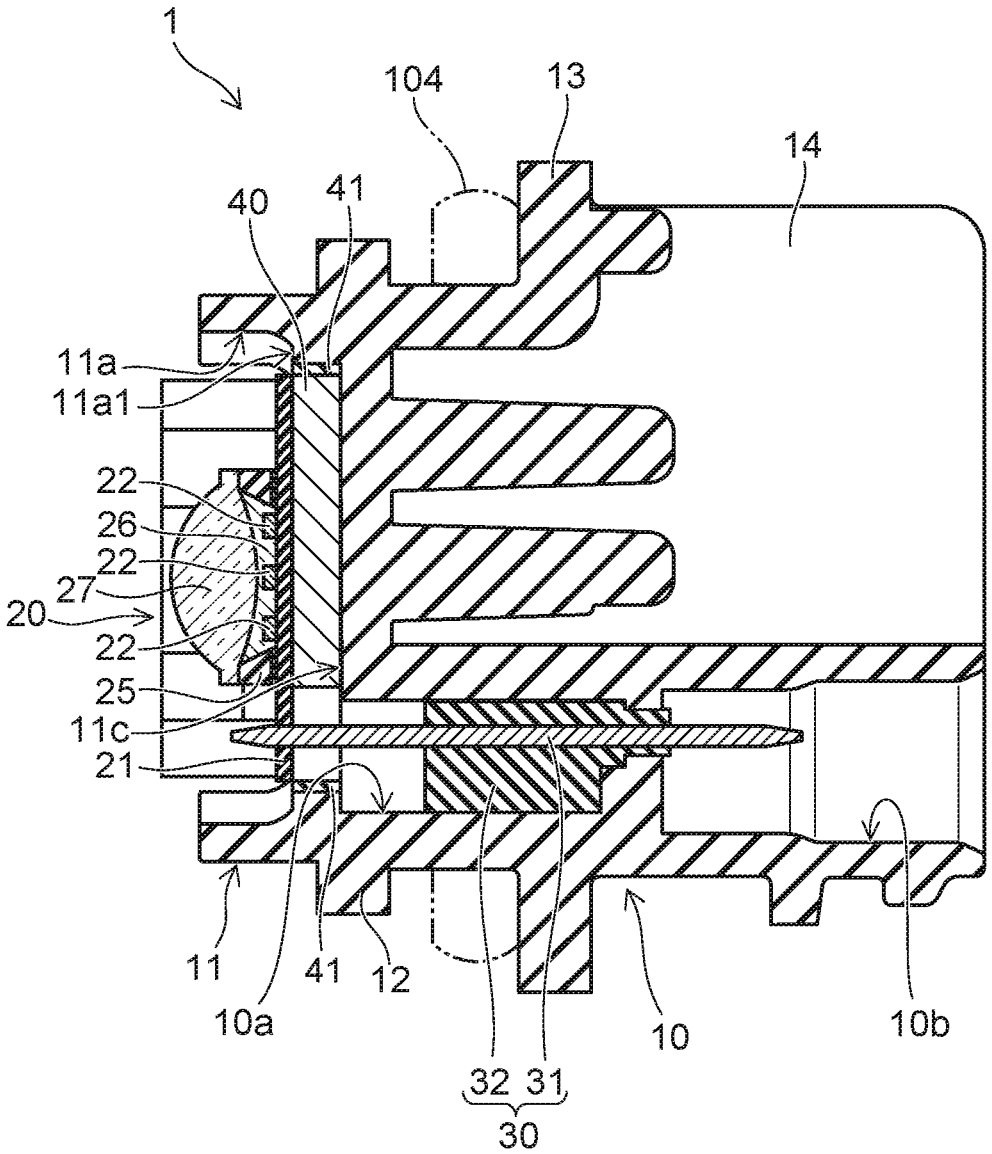
FIG. 2 is a cross-sectional view taken along line A-A.

FIG. 2 is a cross-sectional view taken along line A-A in the vehicle lighting device 1 in FIG. 1.

As illustrated in FIG. 1 and FIG. 2, a socket 10, a light-emitting module 20, a power supply unit 30, and a heat transfer portion 40 can be provided in the vehicle lighting device 1.

The socket 10 can include a mounting portion 11, a bayonet 12, a flange 13, and a thermal radiation fin 14.

The mounting portion 11 can be provided on a surface of the flange 13 which is opposite to a side in which the thermal radiation fin 14 is provided. An external shape of the mounting portion 11 can be set to a columnar shape. For example, the external shape of the mounting portion 11 is a circular column shape. The mounting portion 11 can include a concave portion 11*a* that is opened to an end portion on a side opposite to the flange 13 side.

At least one slit 11*b* can be provided in the mounting portion 11. Respective portions of a substrate 21 can be provided inside the slit 11*b*. A dimension (width) of the slit 11*b* in a peripheral direction of the mounting portion 11 can be set to be slightly greater than dimensions of the respective portions of the substrate 21. In this case, positioning of the substrate 21 can be performed by inserting the respective portions of the substrate 21 into the inside of the slit 11*b*.

In addition, when the slit 11*b* is provided, a planar shape of the substrate 21 can be enlarged. According to this, the number of elements mounted on the substrate 21 can be increased. Alternatively, since the external size of the mounting portion 11 can be decreased, downsizing of the mounting portion 11 and downsizing of the vehicle lighting device 1 can be realized.

In addition, a concave portion 11*c* that is opened to a bottom surface 11*a*1 of the concave portion 11*a* can be provided. The heat transfer portion 40 can be provided in the concave portion 11*c*.

The bayonet 12 can be provided on an outer side surface of the mounting portion 11. For example, the bayonet 12 protrudes toward an outer side of the vehicle lighting device 1. The bayonet 12 can face the flange 13. A plurality of the bayonets 12 can be provided. The bayonet 12 can be used when mounting the vehicle lighting device 1 to a casing 101 of a vehicle lamp 100. The bayonet 12 can be used for twist lock.

The flange 13 can be set to have a plate shape. For example, the flange 13 can be set to have a circular plate shape. An outer side surface of the flange 13 can be located on a further outer side of the vehicle lighting device 1 in comparison to an outer side surface of the bayonet 12.

The thermal radiation fin 14 can be provided in the flange 13 on a side opposite to the mounting portion 11 side. As the thermal radiation fin 14, at least one piece can be provided. For example, a plurality of thermal radiation fins are provided in the socket 10 illustrated in FIG. 1 and FIG. 2. A plurality of the thermal radiation fins 14 can be provided in parallel in a predetermined direction. The thermal radiation fins 14 can be set to have a plate shape.

In addition, a hole 10*b* into which a connector 105 is inserted can be provided in the socket 10. The connector 105 including a sealing member 105*a* can be inserted into the hole 10*b*. According to this, a cross-sectional shape and a cross-sectional dimension of the hole 10*b* can be set to be appropriate for a cross-sectional shape and a cross-sectional dimension of the connector 105 including the sealing member 105*a*.

The socket 10 can have a function of holding the light-emitting module 20 and the power supply unit 30, and a function of transferring heat generated in the light-emitting module 20 to the outside. According to this, it is preferable that the socket 10 is formed from a material such as a metal having high heat conductivity.

In addition, in recent years, the socket 10 is desired to efficiently radiate heat generated in the light-emitting module 20 and to be light in weight. According to this, it is more preferable that the socket 10 is formed from highly heat conductive resin. Examples of the highly heat conductive resin include a filler using a resin and an inorganic resin. For example, the highly heat conductive resin may be obtained by mixing a filler using carbon, aluminum oxide, or the like with a resin such as polyethylene terephthalate (PET) and nylon.

According to the socket 10 which includes the highly heat conductive resin and in which the mounting portion 11, the bayonet 12, the flange 13, and the thermal radiation fin 14 are integrally formed, heat generated in the light-emitting module 20 can be efficiently radiated. In addition, the weight of the socket 10 can be reduced. In this case, the mounting portion 11, the bayonet 12, the flange 13, and the thermal radiation fin 14 can be integrally formed by using an injection molding method, or the like. In addition, the socket 10 and the power supply unit 30 can be integrally formed by using an insert molding method, or the like.

The light-emitting module 20 can be provided on a surface of the heat transfer portion 40 on a side opposite to the bottom surface side of the concave portion 11*c*.

The light-emitting module 20 can include a substrate 21, a light-emitting element 22, a resistor 23, a control element 24, a frame portion 25, a sealing portion 26, and an optical element 27.

For example, the substrate 21 can be bonded onto the heat transfer portion 40. That is, the substrate 21 can be provided on one end portion side of the socket 10. Note that, an adhesive adapted to bond the substrate 21 to the heat transfer portion 40 can be the same adhesive adapted to bond the heat transfer portion 40 to the inside of the concave portion 11*c* as described later. The substrate 21 can be set to have a plate shape. For example, a planar shape of the substrate 21 can be set to a square shape. For example, the substrate 21 can be formed from an inorganic material such as ceramics (for example, aluminum oxide, aluminum nitride, and the like), an organic material such as paper phenol and glass epoxy. In addition, the substrate 21 may be obtained by coating a surface of a metal plate with an insulating material. Note that, when coating the surface of the metal plate with the insulating material, the insulating material may include an organic material, or may include an inorganic material. If the light-emitting element 22 generates a large amount of heat, it is preferable to form the substrate 21 by using a material with high heat conductivity from the viewpoint of thermal radiation. Examples of the material with high heat conductivity include ceramics such as aluminum oxide and aluminum nitride, a highly heat conductive resin, a material obtained by coating a surface of a metal plate with an insulating material, and the like. In addition, the substrate 21 may have a single layer structure or a multi-layer structure.

In addition, an interconnection pattern 21*a* may be provided on the surface of the substrate 21. For example, the interconnection pattern 21*a* can be formed from a material containing silver as a main component, a material containing copper as a main component, or the like.

The light-emitting element 22 can be provided in the substrate 21 on a side opposite to the heat transfer portion 40 side. As the light-emitting element 22, at least one piece can be provided. That is, at least one piece of the light-emitting element 22 can be provided on the substrate 21 in a region on an inner side of the frame portion 25. In the case of the vehicle lighting device 1 illustrated in FIG. 1 and FIG. 2, a plurality of the light-emitting elements 22 are provided. Note that, when providing a plurality of the light-emitting elements 22, the plurality of light-emitting elements 22 can be connected in series. In addition, the light-emitting element 22 and the resistor 23 can be connected in series.

The light-emitting element 22 can be a light-emitting diode, an organic light-emitting diode, a laser diode, or the like.

The light-emitting element 22 can be a chip-shaped light-emitting element. According to the chip-shaped light-emitting element 22, since a region in which the light-emitting element 22 is provided can be reduced, downsizing of the substrate 21 and downsizing of the vehicle lighting device 1 can be realized. The chip-shaped light-emitting element 22 can be mounted with a chip on board (COB). The light-emitting element 22 can be an upper and lower electrode type light-emitting element, an upper electrode type light-emitting element, or a flip chip type light-emitting element. The light-emitting element 22 illustrated in FIG. 1 and FIG. 2 is the upper and lower electrode type light-emitting element. In the upper and lower electrode type light-emitting element or the upper electrode type light-emitting element, the light-emitting element 22 can be electrically connected to the interconnection pattern 21*a* through a wire interconnection 21*b*. For example, the light-emitting element 22 can be electrically connected to the interconnection pattern 21*a* by using a wire bonding method. In the flip chip type light-emitting element, the light-emitting element 22 can be directly mounted on the interconnection pattern 21*a*.

A light emission surface of the light-emitting element 22 faces a front surface side of the vehicle lighting device 1. The light-emitting element 22 emits light mainly toward the front surface side of the vehicle lighting device 1. The number, the size, arrangement, and the like of the light-emitting element 22 can be appropriately changed in correspondence with the size, applications, and the like of the vehicle lighting device 1 without being limited to the exemplified configurations.

The resistor 23 can be provided in the substrate 21 on a side opposite to the heat transfer portion 40. The resistor 23 can be electrically connected to the interconnection pattern 21*a*. For example, the resistor 23 can be a surface mount type resistor, a resistor including a lead wire (a metal oxide film resistor), a film-shaped resistor formed by using a screen printing method, or the like. The resistor 23 illustrated in FIG. 1 is a film-shaped resistor.

A material of the film-shaped resistor can be, for example, ruthenium oxide ($RuO_2$). The film-shaped resistor can be formed by using, for example, a screen printing method and a firing method. If the resistor 23 is a film-shaped resistor, a contact area between the resistor 23 and the substrate 21 can be increased, and thus a heat dissipation property can be improved. In addition, a plurality of the resistors 23 can be formed at a time. According to this, productivity can be improved. In addition, a variation in resistance values of the plurality of resistors 23 can be suppressed.

Here, since a variation exists in forward voltage characteristics of the light-emitting element 22, when an application voltage between an anode terminal and a ground terminal is set to be constant, a variation occurs in brightness of light emitted from the light-emitting element 22 (light flux, luminance, light intensity, and illuminance). According to this, a value of a current flowing through the light-emitting element 22 can be set within a predetermined range by the resistor 23 so that the brightness of the light emitted from the light-emitting element 22 is set within the predetermined range. In this case, the value of the current flowing through the light-emitting element 22 can be set within a predetermined range by changing a resistance value of the resistor 23.

If the resistor 23 is the surface mount type resistor, the resistor including a lead wire, or the like, a resistor 23 having an appropriate resistance value in correspondence with the forward voltage characteristics of the light-emitting element 22 can be selected. If the resistor 23 is the film-shaped resistor, when a part of the resistor 23 is removed, the resistance value can be increased. The number, the size, arrangement, and the like of the resistor 23 is not limited to the example, and can be appropriately changed in correspondence with the number, specifications, and the like of the light-emitting element 22.

The control element 24 can be provided in the substrate 21 on a side opposite to the heat transfer portion 40 side. The control element 24 can be electrically connected to the interconnection pattern 21*a*. The control element 24 can be provided so that a reverse voltage is not applied to the light-emitting element 22, and so that a pulse noise from a reverse direction is not applied to the light-emitting element 22. For example, the control element 24 can be a diode. For example, the control element 24 can be a surface mount type diode, a diode including a lead wire, or the like. The control element 24 illustrated in FIG. 1 is the surface mount type diode.

In addition, a pull-down resistor can be provided for detection of conduction relating to the light-emitting element 22, prevention of erroneous lighting, or the like. In addition, a cover portion that covers the interconnection pattern 21*a*, the film-shaped resistor, or the like can be provided. For example, the cover portion can include a glass material.

The frame portion 25 can be provided in the substrate 21 on a side opposite to the heat transfer portion 40 side. The frame portion 25 can be bonded onto the substrate 21. The frame portion 25 can be set to have a frame shape. At least one piece of the light-emitting element 22 can be provided in a region surrounded by the frame portion 25. For example, the frame portion 25 can surround a plurality of the light-emitting elements 22.

Note that, description has been given of an example in which the frame portion 25 is molded by using the injection molding method, or the like, and the molded frame portion 25 is bonded to the substrate 21, but there is no limitation to the example. For example, the frame portion 25 can be formed by applying a molten resin onto the substrate 21 in a frame shape by using a dispenser or the like and by curing the resin.

In addition, the frame portion 25 can have a function as a reflector that reflects light emitted from the light-emitting element 22.

The sealing portion 26 can be provided on an inner side of the frame portion 25. The sealing portion 26 can be provided to cover a region surrounded by the frame portion 25. The sealing portion 26 can be provided to cover the light-emitting element 22 and the wire interconnection 21*b*. The sealing portion 26 can be formed from a material having light-transmitting property. For example, the sealing portion 26 can be formed by filling the region surrounded by the frame portion 25 with a resin. Filling with the resin can be performed, for example, by using a dispenser or the like. For example, the filling resin can be a silicone resin or the like. In addition, a phosphor can be included in the sealing portion 26. For example, the phosphor can be a YAG-based phosphor (yttrium-aluminum-garnet-based phosphor). However, the type of phosphor can be appropriately changed so as to obtain a predetermined emission color in correspondence with the application of the vehicle lighting device 1.

The optical element 27 can be provided on the sealing portion 26. For example, the optical element 27 can be provided to perform diffusion, condensing, or the like with respect to light emitted from the light-emitting element 22. As an example, the optical element 27 illustrated in FIG. 1 and FIG. 2 is a convex lens. The optical element 27 that is the convex lens is configured to condense light to obtain predetermined light distribution characteristics. Note that, the optical element 27 is not limited to the convex lens, and may be, for example, a concave lens, a light guide, or the like.

Note that, details of the optical element 27 will be described later.

The power supply unit 30 can have a power supply terminal 31 and a holding portion 32.

The power supply terminal 31 can be set as a rod-shaped body. The power supply terminal 31 can protrude from the bottom surface 11*a*1 of the concave portion 11*a*. A plurality of the power supply terminals 31 can be provided. The plurality of power supply terminals 31 can be aligned in a predetermined direction. The plurality of power supply terminals 31 extend through the inside of the holding portion 32. End portions of the plurality of power supply terminals 31 on the light-emitting module 20 side can be soldered to the interconnection pattern 21*a* provided in the substrate 21. End portions of the plurality of power supply terminals 31 on the thermal radiation fin 14 side can be exposed to the inside of the hole 10*b*. A connector 105 can be inserted around the plurality of power supply terminals 31 exposed to the inside of the hole 10*b*. For example, the power supply terminals 31 can be formed from a metal such as a copper alloy. Note that, the number, a shape, arrangement, a material, and the like of the power supply terminals 31 are not limited to the example, and can be appropriately changed.

As described above, it is preferable that the socket 10 is formed form a material having high heat conductivity. However, the material having high heat conductivity may have electrical conductivity. For example, a high heat conductive resin or the like that uses a filler including carbon has electrical conductivity. According to this, the holding portion 32 can be provided to insulate the power supply terminals 31 and the socket 10 having electrical conductivity from each other. In addition, the holding portion 32 can have a function of holding the plurality of power supply terminals 31. Note that, when the socket 10 is formed from the high heat conductive resin (for example, a high heat conductive resin including a filler that includes aluminum oxide) having an insulating property, the holding portion 32 can be omitted. In this case, the socket 10 can hole the plurality of power supply terminals 31.

The holding portion 32 can be formed from a resin having an insulating property. For example, the holding portion 32 can be inserted into a hole 10*a* provided in the socket 10, or can be bonded to an inner wall of the hole 10*a*.

The heat transfer portion 40 can be provided inside the concave portion 11*c* provided in one end portion of the socket 10. For example, the heat transfer portion 40 can be bonded to the inside of the concave portion 11*c*. It is preferable that an adhesive used in bonding of the heat transfer portion 40 is set as an adhesive having high heat conductivity. For example, the adhesive can be set as an adhesive in which a filler using an inorganic material is mixed. For example, heat conductivity of the adhesive can be set to 0.5 to 10 W/(m·K). In this case, a layer formed when the adhesive is cured becomes a heat transfer layer 41.

In addition, the heat transfer portion 40 can be provided inside the concave portion 11*c* through a layer including heat conductive grease (thermal radiation grease). For example, the heat conductive grease can be obtained by mixing a filler using an inorganic material in modified silicone. For example, heat conductivity of the heat conductive grease can be set to 1 to 5 W/(m·K). In this case, a layer that is provided between the heat transfer portion 40 and an inner wall of the concave portion 11*c* and includes the heat conductive grease becomes the heat transfer layer 41.

For example, the heat transfer portion 40 is provided in order for heat generated in the light-emitting module 20 to be easily transferred to the socket 10. According to this, it is preferable that the heat transfer portion 40 is formed from a material having high heat conductivity. The heat transfer portion 40 has a plate shape, and can be formed from, for example, a metal such as aluminum, an aluminum alloy, copper, and a copper alloy. For example, a planar shape of the heat transfer portion 40 can be set to approximately the same shape as a planar shape of the substrate 21. However, the heat transfer portion 40 can be provided with a groove or a hole for preventing short-circuiting with the plurality of power supply terminals 31. For example, planar dimensions of the heat transfer portion 40 can be set to approximately the same planar dimensions as planar dimensions of the substrate 21.

When the heat transfer portion 40 is provided inside the concave portion 11*c* through bonding or through the layer including the heat transfer grease, the layer formed from the adhesive or the layer including the heat conductive grease becomes a buffer material against heat stress or vibration, and thus occurrence of a gap between the heat transfer portion 40 and the socket 10 or detachment of the heat transfer portion 40 can be suppressed.

Note that, if heat generated in the light-emitting module 20 is less, the heat transfer portion 40 can be omitted. When the heat transfer portion 40 is omitted, for example, the light-emitting module 20 can be bonded to the bottom surface 11*a*1 of the concave portion 11*a*, or the like.

Next, the optical element 27 will be further described.

Figure 3A:
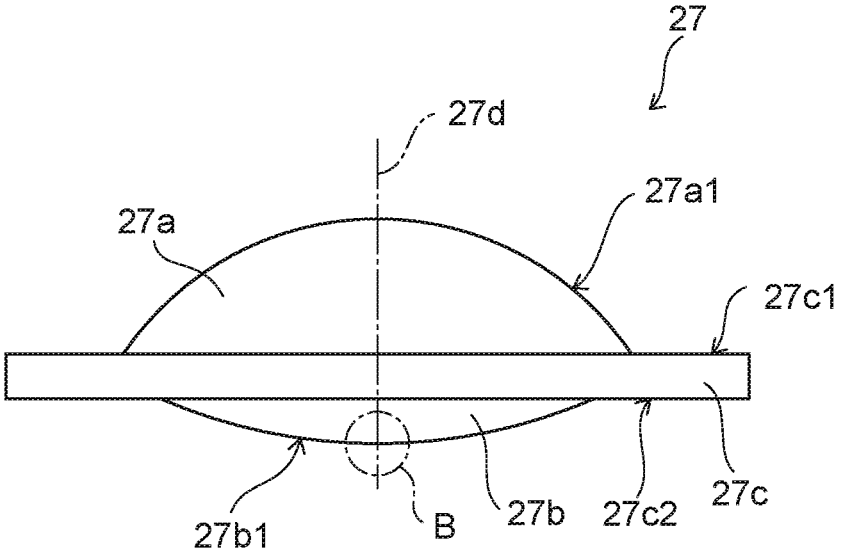
FIG. 3A is a schematic side view illustrating an optical element.

FIG. 3A is a schematic side view illustrating the optical element 27.

Figure 3B:
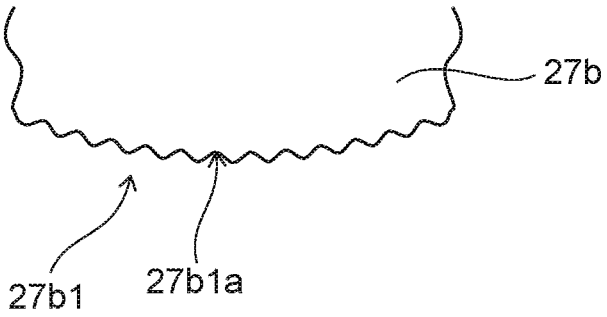
FIG. 3B is a schematic enlarged view of a portion B.

FIG. 3B is a schematic enlarged view of a portion B in the optical element 27 in FIG. 3A.

As illustrated in FIG. 3A, the optical element 27 can include an optical unit 27*a* (corresponding to an example of a second optical unit), an optical unit 27*b* (corresponding to an example of a first optical unit), and a flange 27*c*. The optical unit 27*a*, the optical unit 27*b*, and the flange 27*c* can be integrally formed.

The optical unit 27*a* protrudes to a side of the flange 27*c* which is opposite to the sealing portion 26 side. The optical unit 27*a* has a shape protruding in a direction along a central axis 27*d* of the optical element 27. An outer surface 27*a*1 of the optical unit 27*a* can be set to a convex curved surface.

The optical unit 27*b* protrudes a side of the flange 27*c* which is the sealing portion 26 side. The optical unit 27*b* has a shape protruding to a side opposite to the optical unit 27*a* in the direction along the central axis 27*d* of the optical element 27. An outer surface 27*b*1 of the optical unit 27*b* can be set to a convex curved surface. A central axis of the optical unit 27*a* and a central axis of the optical unit 27*b* can be set to overlap the central axis 27*d* of the optical element 27. The optical unit 27*a* and the optical unit 27*b* can have a convex lens function.

Note that, the optical unit 27*b* can be omitted. Even when the optical unit 27*b* is omitted, the optical unit 27*a* can retain the convex lens function. However, if the optical unit 27*b* is provided, when pressing the optical element 27 against a material of the sealing portion 26 before being cured, it is easy to push the material of the sealing portion 26 to an outer side of the frame portion 25. According to this, it is easy to discharge air trapped between the optical element 27 and the material of the sealing portion 26. In addition, it is possible to suppress excessive pressure from acting on the light-emitting element 22 or the wire interconnection 21*b*.

The flange 27*c* can be set to have a plate shape. For example, the flange 27*c* can be set to have a ring shape. In the direction along the central axis 27*d* of the optical element 27, the flange 27*c* is located between the optical unit 27*a* and the optical unit 27*b*. In a direction orthogonal to the central axis 27*d* of the optical element 27, the flange 27*c* is provided on an outer side of the optical unit 27*a* and the optical unit 27*b*. For example, the flange 27*c* can be provided to surround a peripheral edge of the optical unit 27*a* and a peripheral edge of the optical unit 27*b*.

The optical element 27 can be formed from a light-transmitting material. The light-transmitting material can be glass, but it is preferable that the optical element 27 is formed from a light-transmitting resin in consideration of a reduction in the manufacturing cost. The optical element 27 including the light-transmitting resin can be formed by, for example, an injection molding method, a mold molding method, or the like.

In this case, when considering that a temperature of the optical element 27 rises due to heat generated when the light-emitting element 22 is turned on, it is preferable to use a light-transmitting resin having heat resistance. In addition, since light emitted from the light-emitting element 22 or sunlight includes ultraviolet rays, it is preferable to use a translucent resin having resistance to ultraviolet rays. In consideration of the above-described circumstances, it is more preferable that the optical element 27 include a silicone resin.

Here, the light-transmitting resin such as the silicon resin may have tackiness (stickiness). If the tackiness of the optical element 27 is strong, the optical element 27 may stick to a holding member or an accommodation member, or a plurality of the optical elements 27 may stick to each other.

Figure 4A:
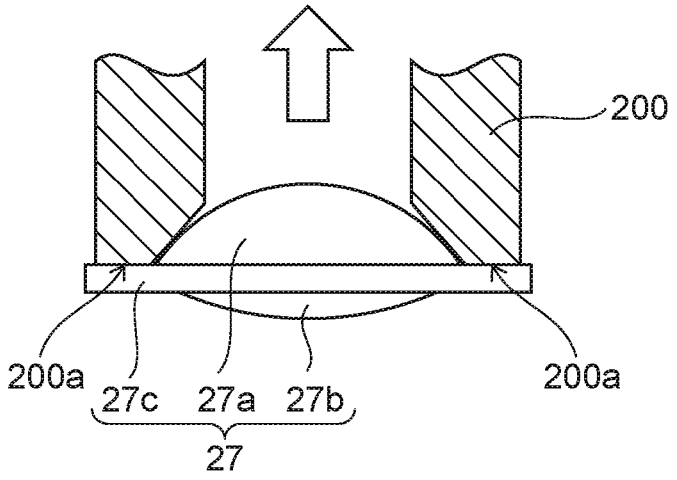
FIGS. 4A to 4C are schematic partial cross-sectional views illustrating tackiness of the optical element.
Figure 4B:
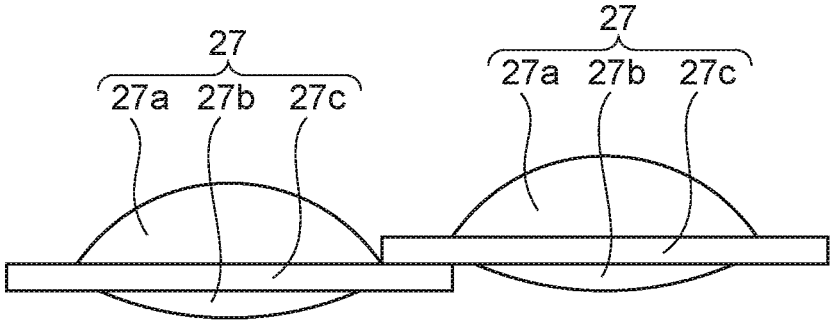
Figure 4C:
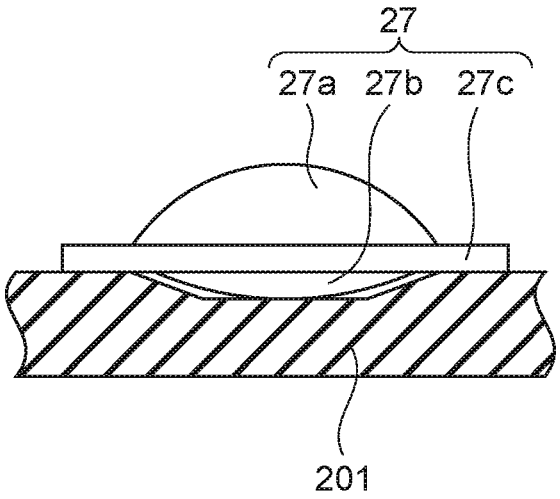

FIGS. 4A to 4C are schematic partial cross-sectional views illustrating tackiness of the optical element 27.

When providing the optical element 27 on the sealing portion 26, for example, each of the optical elements 27 can be suctioned by a vacuum chuck 200 as illustrated in FIG. 4A. According to this, if the tackiness of the optical element 27 is strong, the optical element 27 may stick to an end portion 200*a* of the vacuum chuck 200. When the optical element 27 is mounted on the sealing portion 26, the vacuum chuck 200 releases suctioning of the optical element 27, but when the optical element 27 sticks to the end portion 200*a* of the vacuum chuck 200, detachment of the optical element 27 is hindered, and thus there is a concern that a mounting position of the optical element 27 may be deviated. When the mounting position of the optical element 27 deviates, there is a concern that desired light distribution characteristics and the like may not be obtained. Note that, this is also true of a case where the optical element 27 is held by a chuck including an opening and closing claw or the like.

In addition, when a plurality of the optical elements 27 are put in a bag or the like and are collectively conveyed, or when the plurality of optical elements 27 are put into a hopper or the like, the optical elements 27 may stick to each other as illustrated in FIG. 4B. When the optical elements 27 stick to each other, a process of separating the optical elements 27 occurs.

In addition, when the optical element 27 is accommodated in an accommodation member 201 such as a tray, as illustrated in FIG. 4C, the optical elements 27 and the accommodation member 201 may stick to each other. When the optical element 27 and the accommodation member 201 stick to each other, there is a concern that detachment of the optical element 27 is hindered, and thus suctioning by the vacuum chuck 200 may not be performed, a position of the optical element 27 that is held may deviate, or the posture of the optical element 27 may be unstable.

According to the finding obtained by the present inventors, when the arithmetic-average roughness Ra of an outer surface of the optical element 27 is set to 0.3 to 2.0 μm, tackiness of the optical element 27 is suppressed, and an influence on the optical characteristics of the optical element 27 decreases. In this case, a total region of the outer surface of the optical element 27 may be set to the above-described roughness, or a partial region of the outer surface of the optical element 27 may be set to the above-described roughness. However, if the region having the above-described roughness becomes broad, tackiness of the optical element 27 can be effectively suppressed.

For example, a surface of a mold that is used in injection molding or mold molding is set to 0.3 to 2.0 μm in terms of the arithmetic-average roughness Ra, the roughness of the outer surface of the optical element 27 can be set to the above-described range. For example, when the surface of the mold is subjected to a blast treatment, the roughness of the mold can be set to the above-described range. Note that, if using a mold that is not subjected to the blast treatment, the roughness of the outer surface of the optical element 27 becomes 0.2 μm or less in terms of the arithmetic-average roughness Ra.

In addition, as illustrated in FIG. 3B, a plurality of fine concave portions 27*b*1*a* are provided in a surface, which comes into contact with the sealing portion 26, on an outer surface of the optical element 27. A part of the sealing portion 26 is provided inside the plurality of concave portions 27*b*1*a*, and thus joining strength between the optical element 27 and the sealing portion 26 can be enlarged.

Here, when the arithmetic-average roughness Ra is further increased, tackiness of the optical element 27 can be further weakened. In addition, the joining strength between the optical element 27 and the sealing portion 26 can be further enlarged. However, when the arithmetic-average roughness Ra is further increased, there is a concern that an influence on the optical characteristics of the optical element 27 may excessive increase.

In this case, in a side surface 27*c*1 of the flange 27*c* on the optical unit 27*a* side, and a side surface 27*c*2 of the flange 27*c* on the optical unit 27*b* side, the influence on the optical characteristics of the optical element 27 is small. Accordingly, the roughness of the surfaces 27*c*1 and 27*c*2 can be further increased. According to the finding obtained by the present inventors, when at least any one of the arithmetic-average roughness Ra of the surface 27*c*1, and the arithmetic-average roughness Ra of the surface 27*c*2 is set to 0.3 to 2.0 μm, it is possible to sufficiently weaken the tackiness of the optical element 27.

In addition, as described above, the outer surface 27*b*1 of the optical unit 27*b* comes into contact with a material of the sealing portion 26 before being cured. According to this, the inside of the fine concave portions 27*b*1*a* provided in the outer surface 27*b*1 can be filled with the material of the sealing portion 26. When a part of the sealing portion 26 is provided inside the concave portions 27*b*1*a*, even when the arithmetic-average roughness Ra of the outer surface 27*b*1 of the optical unit 27*b* is set to 0.3 to 2.0 μm, it is possible to further suppress an influence on the optical characteristics of the optical unit 27*b*. In this case, when a difference between a refractive index of the optical unit 27*b* and a refractive index of the sealing portion 26 decreases, an influence on the optical characteristics of the optical unit 27*b* can be further reduced by the roughness of the outer surface 27*b*1. According to this, it is preferable that the material of the optical element 27 and the material of the sealing portion 26 are set to the same as each other. For example, the optical element 27 can include a silicone resin, and the sealing portion 26 can include the silicon resin.

Note that, the roughness of the outer surface 27*a*1 of the optical unit 27*a* has a great influence on the optical characteristics of the optical unit 27*a*, and optical characteristics of the optical element 27. In this case, when the arithmetic-average roughness Ra of the outer surface 27*a*1 of the optical unit 27*a* is set to 1.0 μm or less, it is possible to reduce the influence on the optical characteristics of the optical element 27. However, when considering the optical characteristics of the optical element 27, it is preferable that the arithmetic-average roughness Ra of the outer surface

27*a*1 of the optical unit 27*a* is set to 0.2 μm or less. For example, the blast treatment may not be performed with respect to a portion corresponding to the outer surface 27*a*1 of the optical unit 27*a*.

Figure 5A:
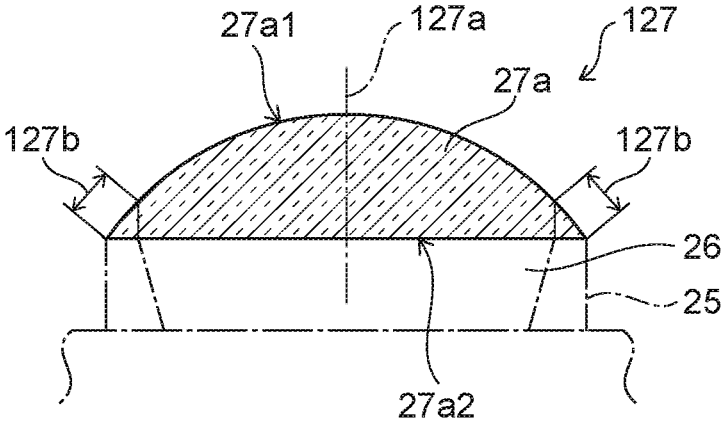
FIGS. 5A and 5B are schematic views illustrating an optical element according to another embodiment.
Figure 5B:
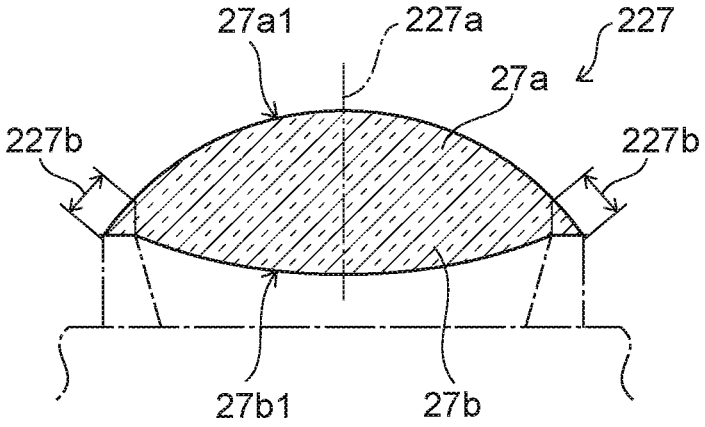

FIGS. 5A and 5B are schematic views illustrating an optical element according to another embodiment.

As illustrated in FIG. 5A, only the above-described optical element 27*a* is provided in an optical element 127. As described above, when the arithmetic-average roughness Ra of an outer surface of the optical element 127 is set to 0.3 to 2.0 μm, tackiness of the optical element 127 is suppressed, and an influence on optical characteristics of the optical element 127 decreases.

In addition, as in the above-described outer surface 27*b*1, a surface 27*a*2 of the optical element 127 on the sealing portion 26 side comes into contact with the material of the sealing portion 26 before being cured. Accordingly, even when the arithmetic-average roughness Ra of the surface 27*a*2 is set to 0.3 to 2.0 μm, an influence on the optical characteristics of the optical element 127 can be suppressed. In addition, tackiness of the optical element 127 can be sufficiently weakened, or joining strength between the optical element 127 and the sealing portion 26 can be enlarged.

The roughness of the outer surface 27*a*1 of the optical element 127 (optical unit 27*a*) has a great influence on the optical characteristics of the optical element 127, and thus the roughness can be set to 1.0 μm or less in terms of the arithmetic-average roughness Ra. In this case, as in the case of the above-described optical element 27, it is more preferable that the arithmetic-average roughness Ra of the outer surface 27*a*1 is set to 0.2 μm or less.

Note that, when viewed from a direction along a central axis 127*a* of the optical element 127, a region 127*b* of the outer surface 27*a*1 which overlaps the frame portion 25 has a relative small influence on the optical characteristics of the optical element 127. Accordingly, the arithmetic-average roughness Ra of the region 127*b* may be set to 0.3 to 2.0 μm.

As illustrated in FIG. 5B, only the optical unit 27*a* and the optical unit 27*b* are provided in an optical element 227. As described above, when the arithmetic-average roughness Ra of an outer surface of the optical element 227 is set to 0.3 to 2.0 μm, tackiness of the optical element 227 is suppressed, and an influence on the optical characteristics of the optical element 227 decreases.

In addition, as described above, a surface 27*b*1 of the optical element 227 on the sealing portion 26 side comes into contact with the material of the sealing portion 26 before being cured. Accordingly, even when the arithmetic-average roughness Ra of the surface 27*b*1 is set to 0.3 to 2.0 μm, an influence on the optical characteristics of the optical element 227 can be suppressed. In addition, tackiness of the optical element 227 can be sufficiently weakened, or joining strength between the optical element 227 and the sealing portion 26 can be enlarged.

The roughness of an outer surface 27*a*1 of the optical element 227 (optical unit 27*a*) has a great influence on the optical characteristics of the optical element 227, and thus the roughness can be set to 1.0 μm or less in terms of the arithmetic-average roughness Ra. In this case, as in the case of the above-described optical element 27, it is more preferable that the arithmetic-average roughness Ra of the outer surface 27*a*1 is set to 0.2 μm or less.

Note that, when viewed from a direction along a central axis 227*a* of the optical element 227, a region 227*b* of the outer surface 27*a*1 which overlaps the frame portion 25 has a relatively small influence on the optical characteristics of the optical element 227, and thus the arithmetic-average roughness Ra of the region 227*b* may be set to 0.3 to 2.0 μm.

Note that, the above-described flange 27*c* is not provided in the optical elements 127 and 227. In this manner, the flange 27*c* may be omitted. However, when the flange 27*c* is provided, as illustrated in FIG. 4A, holding of the optical element 27 by the vacuum chuck 200 or the like becomes easy. In addition, the posture of the optical element 27 held by the vacuum chuck 200 or the like can be stable.

(Vehicle Lamp)

Next, a vehicle lamp 100 will be described.

Note that, in the following description, as an example, a case where the vehicle lamp 100 is a front combination light provided in an automobile will be described. However, the vehicle lamp 100 is not limited to the front combination light provided in an automobile. The vehicle lamp 100 may be a vehicle lamp that is provided in an automobile, a railway vehicle, and the like.

Figure 6:
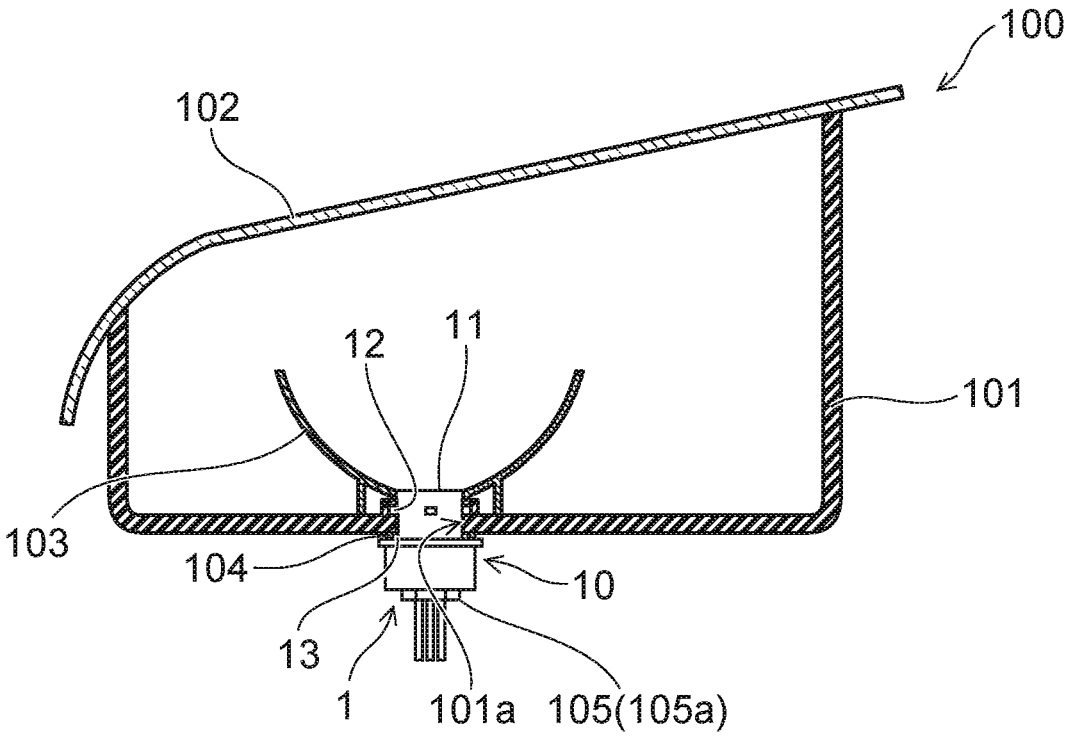
FIG. 6 is a schematic partial cross-sectional view illustrating a vehicle lamp.

FIG. 6 is a schematic partial cross-sectional view illustrating the vehicle lamp 100.

As illustrated in FIG. 6, the vehicle lighting device 1, a casing 101, a cover 102, an optical element 103, a sealing member 104, and a connector 105 can be provided in the vehicle lamp 100.

The vehicle lighting device 1 can be attached to the casing 101. The casing 101 can hold the mounting portion 11. The casing 101 can have a box shape in which one end side is opened. For example, the casing 101 can be formed from a resin or the like through which light is not transmitted. An attaching hole 101*a*, into which a portion of the mounting portion 11 in which the bayonet 12 is provided is inserted, can be provided in a bottom surface of the casing 101. A concave portion into which the bayonet 12 provided in the mounting portion 11 is inserted can be provided in a peripheral edge of the attaching hole 101*a*. Note that, a case where the attaching hole 101*a* is directly provided in the casing 101 has been described, but a mounting member including the attaching hole 101*a* may be provided in the casing 101.

When attaching the vehicle lighting device 1 to the vehicle lamp 100, a portion of the mounting portion 11 in which the bayonet 12 is provided is inserted into the attaching hole 101*a*, and the vehicle lighting device 1 is rotated. In this case, for example, the bayonet 12 is held to a fitting portion provided in the peripheral edge of the attaching hole 101*a*. This attaching method is referred to as twist-lock.

The cover 102 can be provided to clog an opening of the casing 101. The cover 102 can be formed from a light-transmitting resin or the like. The cover 102 can be set to have a function of a lens or the like.

Light emitted from the vehicle lighting device 1 is incident to the optical element 103. The optical element 103 can perform reflection, diffusion, guiding, condensing, formation of a predetermined light distribution pattern of light emitted from the vehicle lighting device 1, and the like. For example, the optical element 103 illustrated in FIG. 6 is a reflector. In this case, the optical element 103 can form a predetermined light distribution pattern by reflecting light emitted from the vehicle lighting device 1.

The sealing member 104 can be provided between the flange 13 and the casing 101. The sealing member 104 can be set to have an annular shape. The sealing member 104 can be formed from a material having elasticity such a rubber and a silicone resin.

When the vehicle lighting device 1 is attached to the vehicle lamp 100, the sealing member 104 is inserted between the flange 13 and the casing 101. According to this, an inner space of the casing 101 can be hermetically sealed by the sealing member 104. In addition, the bayonet 12 is pressed against the casing 101 due to an elastic force of the sealing member 104. According to this, the vehicle lighting device 1 can be suppressed from being detached from the casing 101.

The connector 105 can be inserted around end portions of the plurality of power supply terminals 31 exposed to the inside of the hole 10*b*. A power supply and the like (not illustrated) can be electrically connected to the connector 105. According to this, it is possible to electrically connect the power supply and the like, and the light-emitting element 22 to each other by inserting the connector 105 around end portions of the terminals of the plurality of power supply terminals 31.

In addition, the sealing member 105*a* can be provided in the connector 105. When the connector 105 including the sealing member 105*a* is inserted into the hole 10*b*, the hole 10*b* is water-tightly sealed. The sealing member 105*a* has an annular shape, and can be formed from a material having elasticity such as a rubber and a silicone resin.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A vehicle lighting device comprising:
a socket;
a substrate that is provided on one end portion side of the socket;
a frame portion that is provided on the substrate;
at least one light-emitting element that is provided in a region on an inner side of the frame portion on the substrate;
a sealing portion that is provided on an inner side of the frame portion and covers the light-emitting element; and
an optical element that is provided on the sealing portion,
an arithmetic-average roughness value of a first surface on the sealing portion side in the optical element being greater than an arithmetic-average roughness value of a second surface of the optical element on a side opposite to the first surface.

2. The device according to claim 1,
wherein arithmetic-average roughness of the first surface is 0.3 to 2.0 μm.

3. The device according to claim 1,
wherein arithmetic-average roughness of the second surface is 0.3 to 2.0 μm.

4. The device according to claim 1,
wherein a part of the sealing portion is provided inside a plurality of concave portions provided in the first surface.

5. The device according to claim 1,
wherein the optical element is a convex lens.

6. The device according to claim 1,
wherein the optical element includes,
a flange having a plate shape,
a first optical unit that protrudes to a side of the flange which is the sealing portion side, and
a second optical unit that protrudes to a side of the flange which is opposite to the sealing portion side,
an outer surface of the first optical unit is the first surface, and
an outer surface of the second optical unit is the second surface.

7. The device according to claim 6,
wherein the flange, the first optical unit, and the second optical unit are integrally formed.

8. The device according to claim 6,
wherein the outer surface of the first optical unit is a convex curved surface.

9. The device according to claim 6,
wherein the outer surface of the second optical unit is a convex curved surface.

10. The device according to claim 6,
wherein the flange surrounds a peripheral edge of the first optical unit and a peripheral edge of the second optical unit.

11. The device according to claim 6,
wherein arithmetic-average roughness of the outer surface of the first optical unit is 0.3 to 2.0 μm.

12. The device according to claim 6,
wherein at least one of arithmetic-average roughness of a surface of the flange on the first optical unit side, and arithmetic-average roughness of a surface of the flange on the second optical unit side is 0.3 to 2.0 μm.

13. The device according to claim 1
wherein the optical element includes,
a flange having a plate shape,
a second optical unit that protrudes to a side of the flange which is opposite to the sealing portion side,
an outer surface of the flange on a side opposite to the second optical unit side is the first surface, and
an outer surface of the second optical unit is the second surface.

14. The device according to claim 13,
wherein the flange and the second optical unit are integrally formed.

15. The device according to claim 13,
wherein arithmetic-average roughness of the outer surface of the flange on a side opposite to the second optical unit side is 0.3 to 2.0 μm.

16. The device according to claim 1,
wherein the optical element includes a curved surface that protrudes to a side opposite to the sealing portion side, and a flat surface provided on the sealing portion side,
the curved surface is the second surface, and
the flat surface is the first surface.

17. The device according to claim 16,
wherein arithmetic-average roughness of the flat surface is 0.3 to 2.0 μm.

18. The device according to claim 1,
wherein the optical element includes a light-transmitting material.

19. The device according to claim 1,
wherein the optical element includes a silicone resin.

20. A vehicle lamp comprising:
the vehicle lighting device according to claim 1; and
a casing to which the vehicle lighting device is attached.

* * * * *